US005664508A

United States Patent [19]

Mulcahey et al.

[11] Patent Number: 5,664,508

[45] Date of Patent: Sep. 9, 1997

[54] METHOD AND APPARATUS FOR FORMING THE SIDE PANEL OF A MATTRESS SACK

[75] Inventors: Charles E. Mulcahey, Beverly; Michael R. Porter, Topsfield, both of Mass.

[73] Assignee: Porter Sewing Machines, Inc., Beverly, Mass.

[21] Appl. No.: 620,087

[22] Filed: Mar. 21, 1996

[51] Int. Cl.[6] ..... D05B 11/00; D05B 19/12

[52] U.S. Cl. ..... 112/2.1; 112/153; 112/163; 112/277; 112/470.05; 112/475.06

[58] Field of Search ..... 112/163, 153, 112/277, 275, 470.02, 470.03, 470.05, 475.02, 475.03, 475.06, 475.08, 165, 166, 167, 470.01, 2.1; 5/448

[56] References Cited

U.S. PATENT DOCUMENTS 3,363,594 1/1968 Kosrow ..... 112/277 X 4,526,114 7/1985 Martell et al. ..... 112/475.02

4,843,986 7/1989 Kozuka et al. ..... 112/163

5,170,733 12/1992 Honma et al. ..... 112/153 X 5,249,322 10/1993 Seago ..... 112/163 X

*Primary Examiner*—Peter Nerbun

*Attorney, Agent, or Firm*—Wolf, Greenfield & Sacks, P.C.

[57] ABSTRACT

A method and apparatus for forming a side panel for a mattress sack or a box spring enclosure. The apparatus includes a double needle sewing machine and a guide for the ends of the folded side panel which are being stitched together which aligns and guides the ends through the stitching area. Photocells are provided to start and stop the stitching process. The method includes the step of stopping the stitching process after a predetermined number of stitches if light from a second photocell in the feed direction is not interrupted within a predetermined number of stitches.

9 Claims, 3 Drawing Sheets

METHOD AND APPARATUS FOR FORMING THE SIDE PANEL OF A MATTRESS SACK

FIELD OF THE INVENTION

This application relates generally to methods and apparatus for closing mattress sacks and box springs and more particularly to a method and apparatus for forming the side panel of a mattress sack or a box spring enclosure.

BACKGROUND OF THE INVENTION

Modern mattresses typically include an inner construction, such as a spring assembly, covered by a mattress sack. A mattress sack typically includes a top panel and a bottom panel which are joined together by a side panel extending around the perimeter of the mattress sack. A box spring enclosure also includes a top and bottom panel joined by a side panel.

In one technique used to form a mattress sack, or a box spring enclosure; top and bottom panels are first cut to size and hemmed. Typically, the top and bottom panels are quilted and include a layer of foam or other insulating material between two fabric layers. Thereafter, an elongated strip of material, which could be the same material used to form the top or bottom panels, is cut to a suitable length and width to be used as a side panel. The ends of this elongated strip of material are sewn together at a predetermined point, and this endless band is then turned inside out so that the stitch is positioned on the inside facing the inner construction of the mattress or box spring. One lateral edge of this endless band is then stitched to a top or bottom panel along with flange material in a tape edge operation, in which a folded piece of tape material is wrapped about the joined edges of the side and top or bottom panel and flange material, and the entire composite structure is sewn together. The inner construction of the mattress or box spring is then placed within this partially formed mattress sack or box spring enclosure, and the remaining top or bottom panel is then stitched to the opposite lateral edge of the side panel, using a tape edge operation, to completely enclose the inner construction. At this point, the mattress or box spring is substantially finished.

Presently, when the side panel is formed, a strip of material to be used as the side panel is folded in half along a transverse fold so that the two ends are facing in the same direction, are aligned and are placed next to one another along one surface of the strip of material. These two ends are then passed through a conventional single needle chain stitch sewing machine manually to stitch the ends together at a point spaced from the ends of the panel toward the fold in the center of the panel, and along a line transverse to the direction of elongation of the strip. This sewing step typically is repeated at another location spaced from the first stitch to provide strength to the stitch. Presently, this step is not automated. The operator is required to adjust the position of the ends of the side panel manually and manually align them to stitch the ends together at the proper point. As can be imagined, the present method produces a certain amount of error. Sometimes, the stitch is placed too close to the ends of the panel, and the side panel has too large a circumference. Sometimes, the stitch is spaced too far away from the ends of the panel and the circumference of the side panel is too small for the mattress for which it is designed. Either result produces some difficulty in the step of attaching the side panel to the top and bottom panels and a certain amount of manual, time-consuming manipulation of the fabric is required to produce a usable final product. Moreover, passing the side panel twice through the sewing machine and manually adjusting the position of the side panel both take extra time, thus increasing labor costs and reducing safety for the operator.

One object of the present invention is to automate the step of sewing together the ends of the side panel.

Another object of the present invention is to provide a sewing machine which is particularly suited for sewing together the ends of a side panel of a mattress sack with precision while providing a high level of safety for the operator.

SUMMARY OF THE INVENTION

The foregoing and other objects are achieved in accordance with the present invention, which includes an automated method and apparatus for sewing together the ends of a side panel of a mattress sack, or a box spring enclosure, prior to stitching thereof to the top or bottom panel. In one aspect of the method and apparatus of this invention, two photocells are provided, one for initiating the stitching process, and another for terminating the stitching process at a desired point. The provision of two photocells for starting and stopping the stitching operation allows the same machine to be used for any size side panel without reprogramming the machine. In another aspect of the invention, a guide is provided for precisely positioning and guiding the ends of the side panel with respect to the stitching needle. In a further aspect, two needles are utilized which are offset by 1/32 inch so that a single pass through the stitching area of the sewing machine provides the desired strength by producing two, spaced stitches holding together the ends of the side panel.

In another further aspect of the invention, the method involves programming of the machine to stitch a certain number of stitches beyond the edge of the side panel to facilitate the use of a vacuum thread cutter to provide a clean and well trimmed appearance to the side panel. In a further aspect of the method, the stitching operation cannot be commenced until the operator presses a foot peddle to activate the photocells.

In a single pass through the sewing machine, the ends of the side panel are automatically stitched together with two stitches, obviating two passes through the machine, and providing a precisely formed side panel. This method and apparatus saves time and money and provides a high level of precision without compromising safety.

BRIEF DESCRIPTION OF THE DRAWINGS

The invention will be more fully appreciated from the following detailed description, when taken in conjunction with the accompanying drawings, in which.

DETAILED DESCRIPTION

Figure 1:
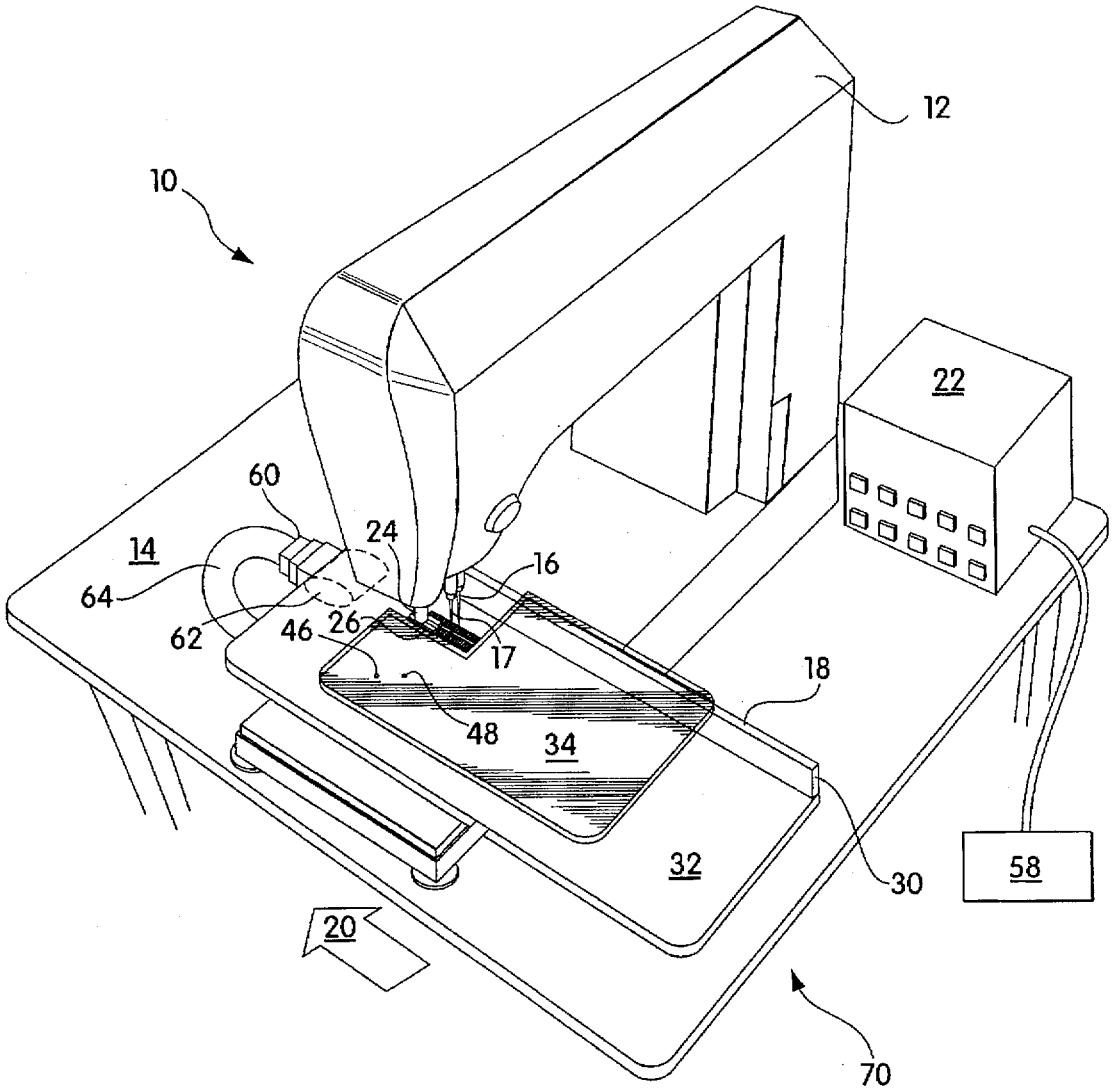
FIG. 1 is a top, perspective view illustrating an exemplary sewing apparatus in accordance with the present invention.

With reference now to the drawings, and more particularly to FIGS. 1–4 thereof, an exemplary apparatus 10 of the present invention will be described. Apparatus 10 includes sewing machine 12 which rests on a sewing surface or table 14 and has two sewing needles 16 and 17 which are closely spaced with respect to one another, and which are found in the stitching area of machine 12. Sewing machine 12 of this invention need not be a programmable sewing machine. Sewing machine 12 includes a controller 22 which controls certain aspects of the operation of sewing machine 12 in addition to other components of the apparatus of this invention as will be described. Sewing machine 12 can be any conventional sewing machine which produces a chain stitch, and may include a PLK series Mitsubishi sewing machine, a 300 W series Singer sewing machine, a Wilcox & Gibbs 515 or 401 series sewing machine, or some other like machine. A preferred machine is a Union Special 51500 (or the like) tandem needle machine. In FIG. 1, the direction of feed of side panel 40 is illustrated by arrow 20, and panel 40 moves from right to left on sewing table 14, as shown in FIG. 1. Panel 40 is initially placed on machine 12 ready for sewing in loading zone 70. However, it is to be understood that the direction of feed could be reversed and panel 40 could go from left to right in FIG. 1 with certain obvious changes in the apparatus.

Sewing needles 16 and 17 are offset or spaced from one another in a direction perpendicular to the feed direction 20. A typical offset perpendicular to the feed direction is about 1/32 of an inch. In this manner, as side panel 40 is fed through the sewing machine, two stitches are formed in edges 42 and 44 of the side panel 40 which are parallel to one another and are closely spaced from one another. This double stitching provides extra strength to the stitched portion of the side panel, and obviates the prior art step of passing the joined ends 42 and 44 of the side panel 40 through the stitching area twice. Needles 16 and 17 may also be offset from one another in a direction parallel to the feed direction 20. Typically, therefore, needles 16 and 17 are spaced from one another at an angle of about 45° with respect to the feed direction 20.

Panel 40 is moved from loading zone 70 through the stitching area, below needles 16 and 17 in feed direction 20 in a conventional manner. A presser foot 24 and a bottom feed dog 26 are part of sewing machine 12. Bottom feed dog 26 advances ends 42 and 44 through the stitching area at the same rate of speed. Bottom feed dog 26 is conventional and typically is coupled to the main drive shaft (not shown) of the sewing machine 12 in a manner well known to those skilled in the art to provide the desired motion in the feed direction 20 and the desired timing of the motion with respect to the up and down motion of needles 16 and 17. Loopers 28 (FIG. 3) carrying threads are provided below the top surface of table 14 and are conventional. As is well known in the art, needle thread carded on needles 16 and 17 is interlocked with thread from loopers 28 to form the desired stitch. Since this technology is all conventional, no further description is required.

Guide assembly 18 resides on the top surface of table 14 and extends in the feed direction to and through the stitching area around needles 16 and 17. Guide assembly 18 includes a back guide plate 30, a bottom plate 32, and a top plate 34. Back guide plate 30 extends parallel to the feed direction 20. Back guide plate 30 is spaced from needles 16 and 17 a predetermined distance in a direction perpendicular to the feed direction 20 and serves to guide edges 42 and 44 of side panel 40 as panel 40 is being fed through the stitching area in the feed direction 20, as will be described. Back guide plate 30 ensures that the two stitches are spaced a predetermined distance from the edges 42 and 44 and that they are formed parallel thereto. Back guide plate 30 can be formed of a hard plastic material or a metal, or of any other suitably durable and hard material. Bottom plate 32 serves as a support for back guide plate 30. Top plate 34 is mounted onto a top edge of back guide plate 30 and is disposed generally parallel to bottom plate 32. Top plate 34 typically is formed of a transparent material to allow viewing of the sewing operation while protecting the operator's hands from the sewing operation. Top plate 34 also assists in guiding edges 42 and 44 of panel 40 through the stitching area. Top plate 34 is cut-out around needles 16 and 17 and presser foot 24 so that top plate 34 does not interfere with the movement thereof. A preferred material having the desired transparent durable, and non-breakable characteristics is plexiglass.

Top plate 34 carries two light sources 46 and 48. Sources 46 and 48 can be any source used in conjunction with a photocell, such as an LED. Disposed directly below light sources 46 and 48 on bottom plate 32 are associated photocells 52 and 50, or the like. Photocells 50 and 52 are coupled to controller 22, and signals sent from photocells 50 and 52 to controller 22 are processed to cause controller 22 to send certain control signals to sewing machine 12, as will be described. It will be understood, of course, that the position of sources 46 and 48 can be reversed with the position of photocells 50 and 52, so light sources 46 and 48 could be disposed on or below bottom plate 32, while photocells 50 and 52 could be disposed in top plate 34.

Figure 2:
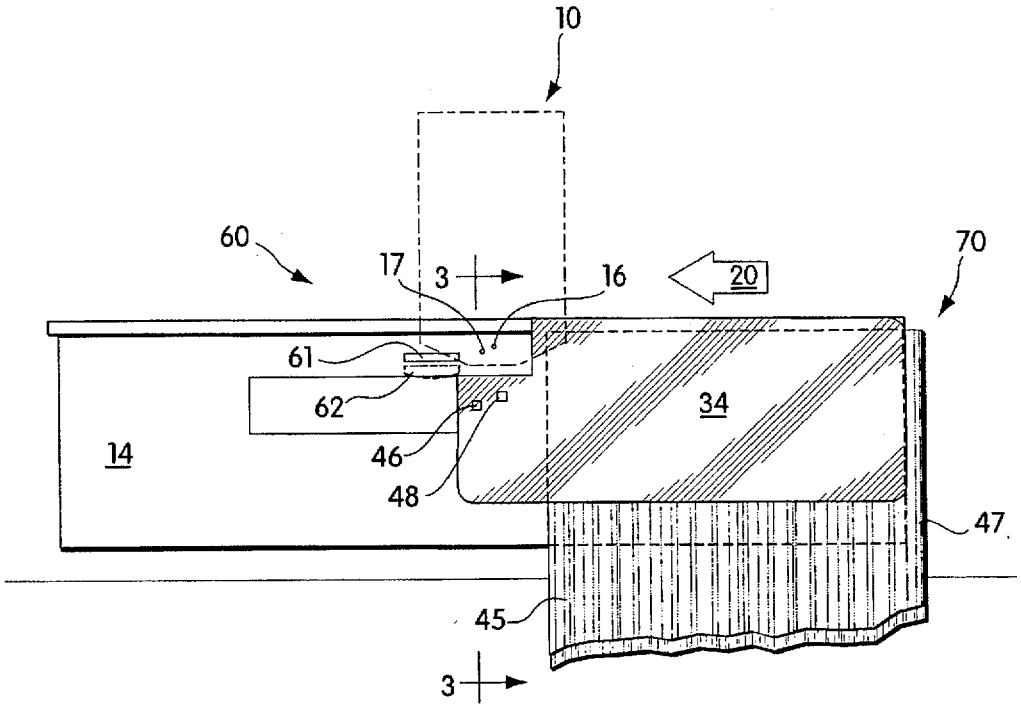
FIG. 2 is a partial, top plan view of the sewing apparatus of FIG. 1.
Figure 3:
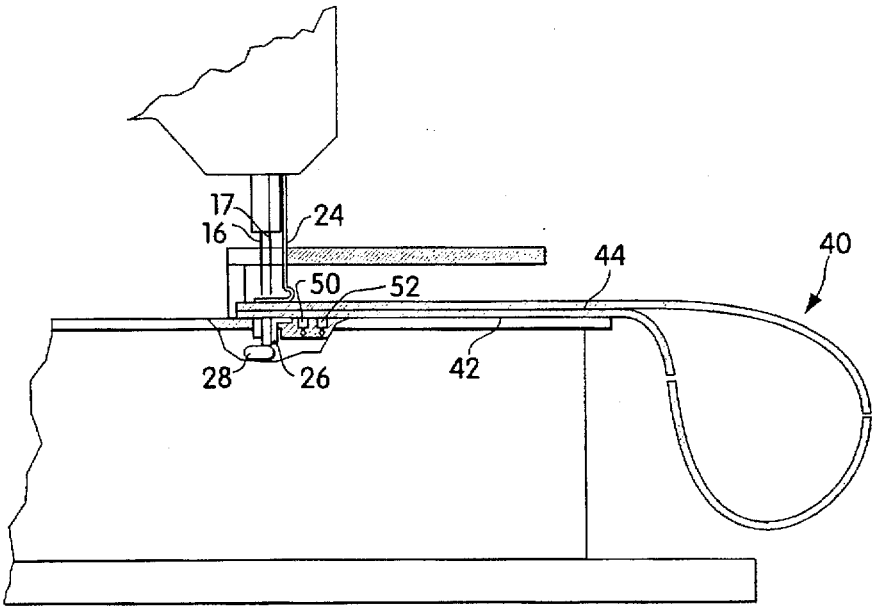
FIG. 3 is a partial, cross-sectional side view of the sewing apparatus of FIG. 2 taken along the line 3—3.
Figure 4:
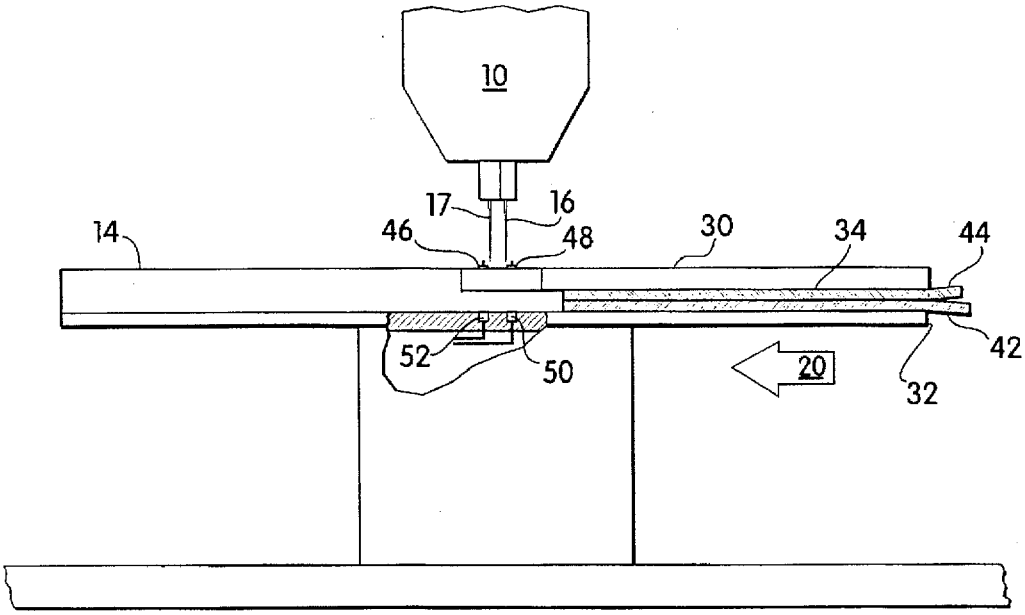
FIG. 4 is a partial, partially cutaway side view of the sewing apparatus of FIG. 1.

As illustrated in FIG. 2, light source 48, as well as associated photocell 50, are almost exactly aligned with needle 16, as measured in a direction parallel to feed direction 20. Needle 16 is the first needle to be encountered by forward lateral edges 45 as side panel 40 is moved to and through the stitching area in the feed direction 20. It can also be seen from FIG. 2, that light source 46 and associated photocell 52 are disposed just after needle 17 as measured in a direction parallel to feed direction 20. Typically, light sources 46 and 48, as well as associated photocells 52 and 50 are offset from one another in the feed direction 20 by about eight-tenths of an inch (0.8"). It can also be seen from FIG. 2 that light sources 46 are 48 are spaced sufficiently far from needles 16 and 17 in a direction perpendicular to the feed direction 20 so as not to interfere with the movement of needles 16 or 17, or of presser foot 24.

Sewing apparatus 10 also includes a foot pedal 58 which is coupled to controller 22 and which must be depressed to initiate the automatic operation of the sewing machine or to activate the photocells. Foot pedal 58 is primarily provided for safety purposes so that the sewing machine does not begin stitching at an inappropriate time, such as when the operator's fingers are manipulating fabric in the stitching area adjacent light sources 46 and 48. It is to be understood that some other conventional device may also be used in substitution for foot pedal 58 to initiate the operation, such as a button on controller 22. However, a foot pedal is referenced because of ease of operation.

Sewing apparatus 10 also includes a conventional vacuum thread cutter 60 which is located just beyond the stitching area in feed direction 20. Vacuum thread cutter 60 includes an opening 61 in table 14 which is coupled by a hose 64 to a source of vacuum (not shown). A knife 62 is disposed in conjunction with opening 61. As edges 42 and 44 of panel 40 pass over opening 61, any trailing thread is sucked into opening 61 and is cut immediately by knife 62 which is triggered by a photocell (not shown) in a manner well known to those skilled in the art.

The method of this invention will now be described with reference to FIGS. 1-7. A strip of material which is destined to become the side panel 40 of a mattress or box spring has already been cut to the desired length and width from a previously formed panel. Typically, the panel 40 includes a middle layer of an insulating material, such as a foam material, which is sandwiched between two layers of fabric. The composite material is stitched together in a conventional manner, and is typically quilted. The length of the panel 40 depends on whether panel 40 is to be used with a single, double, queen or king size mattress or box spring. The length of panel 40 must be slightly longer than the circumference of the corresponding mattress or box spring to accommodate a slight overlap where the two ends 42 and 44 are joined together. This length is measured in a manner well known to those skilled in the art. The width of such a panel 40 depends upon the width or thickness of the inner construction of the mattress or box spring. A typical width for a conventional mattress is about eight inches. Once the panel 40 has been cut to the desired size, it is manually folded in half longitudinally about a transverse fold so that ends 42 and 44 thereof are aligned with one another as closely as possible and are adjacent one another. Also, corresponding lateral edges 45 and 47 of both ends 42 and 44 are aligned manually. If lateral edges 45 or 47 on each end 42 and 44 are not aligned, one end 42 would be offset with regard to the other end 44 in the feed direction, producing an unsightly and unusable panel 40. These two adjacent ends 42 and 44 are then placed on top of bottom plate 32 and beneath top plate 34 in loading zone 70. Edges 42 and 44 are placed in abutting relationship with back guide plate 30 and are retained in a relationship in which each end 42 and 44 is as closely aligned with the other as possible and in which both ends touch back guide plate 30.

Once panel 40 is properly aligned and is in its desired position in loading zone 70, the operator depresses foot peddle 58 to initiate the operation and activate photocells 50 and 52. Once the process has been initiated, the operator manually moves ends 42 and 44 of panel 40 in the feed direction 20, or to the left as shown in FIG. 1, towards needles 16 and 17. As the operator manually feeds panel 40 into the stitching area in feed direction 20, forward lateral edges 45 of ends 42 and 44 interrupt the light passing from light source 48 to photocell 50. This interruption of light sends a signal to controller 22 which results in controller 22 commencing the sewing operation in which needles 16 and 17 begin oscillating in a vertical direction perpendicular to feed direction 20 and to table 14. Presser foot 24 and feed dog 26 also begin moving to grab ends 42 and 44 and feed dog 26 advances them through the stitching area in a manner well known to those skilled in the art. At this point, the operator no longer needs to manually move panel 40 and the remainder of the process is automatic. As edge 45 interrupts the light from light source 46, a signal is also sent to controller 22. If light from light source 46 is not interrupted within a predetermined number of stitches, for example seven stitches, after light from light source 48 is interrupted, controller 22 automatically stops the sewing operation. This feature shuts down the machine 10 in the event of a jam, which would be the only reason why the second light beam would not be interrupted within seven stitches after the first light beam is interrupted.

Figure 5:
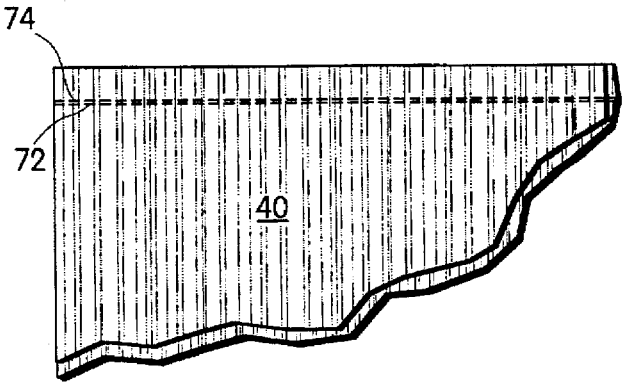
FIG. 5 is a partial top view of the side panel stitch produced by the sewing apparatus of FIG. 1.
Figure 6:
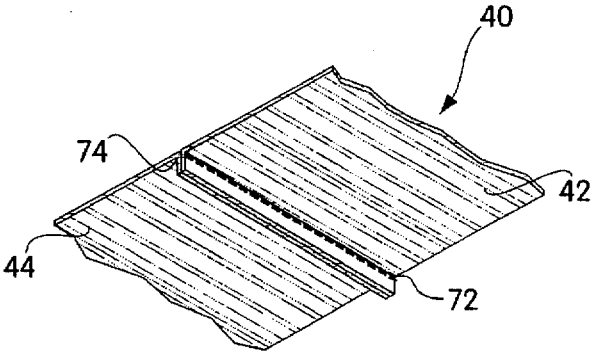
FIG. 6 is a partial perspective view of the stitched portion of the panel of FIG. 5 in an open position.
Figure 7:
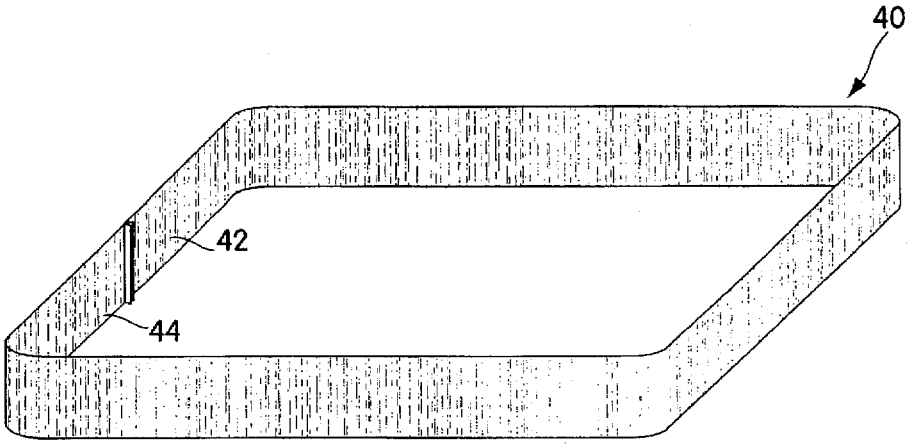
FIG. 7 is a top perspective view of the side panel as it would appear on a mattress sack.

Assuming that forward edge 45 interrupts the second beam of light from source 46 within the predetermined number of stitches of interrupting the first beam from source 48, the sewing operation proceeds in a conventional manner. Needles 16 and 17 produce two parallel but closely spaced chain stitches 72 and 74, as illustrated in FIG. 5. Both stitches 72 and 74 are parallel to edges 42 and 44 and stitch 74 is spaced a predetermined distance, typically one inch therefrom. The sewing operation continues even after trailing edge 47 passes light source 48, until trailing edge 47 of panel 40 passes light source 46. At this point, trailing edge 47 has passed needle 17, and panel 40 is no longer being stitched. The typical number of stitches for this width of material ranges between 30 and 90 stitches. In one embodiment, once the beam from light source 46 is again received by photocell 52, the stitching operation is stopped by controller 22. In a preferred embodiment, the stitching operation continues for a predetermined number of stitches, for example seven stitches, after photocell 52 again receives light from source 46. These last series of stitches after receipt of light from light source 46 are not stitched onto panel 40, but simply produce a trailing piece of stitched thread. As this trailing piece of thread passes over opening 61, it is sucked down into opening 61 and is cut flush with the surface of edge 47 by blade 62. At this point, the stitching operation is complete, and panel 40 is configured as shown in FIG. 6 in the vicinity of stitches 72 and 74. Thereafter, panel 40 is turned inside out, so that stitches 72 and 74 are disposed on the inside of the panel, as shown in FIG. 7. Panel 40 is now ready for attachment to a top or bottom panel on a mattress sack or a box spring enclosure.

The method and apparatus of this invention offer several advantageous over existing techniques for sewing together the ends of the side panel of a mattress sack or a box spring enclosure. In the first place, the provision of two needles allows two stitches to be sewn simultaneously, rather than having to run the side panel through the sewing machine two different times, as is being done presently. Secondly, the provision of the back guide plate 30 allows the operator to immediately align ends 42 and 44 of cover 40 and to place them in their proper position in loading zone 70 with a minimum amount of wasted time and energy. Back guide plate 30 also ensures that this alignment is maintained during the entire stitching process and so that the stitch is at the precise distance from ends 42 and 44 and is parallel thereto. Top plate 34 allows the operator to view the operation while still protecting the operator and preventing injury during the stitching process. The use of photocells to start and stop the stitching operation allows a side panel of any width to be stitched in any order without reprogramming of the sewing machine. The side panels of mattress sacks and box spring enclosures can be of any width, and typically vary greatly from mattress to mattress and box spring to box spring. Also, the photocells provide a safety feature in that if the machine jams, it is automatically stopped, and no stitching can occur, until the operator has fixed the jam. Thus, this apparatus allows for automation of the stitching of the side panel while still providing a maximum degree of flexibility and safety.

It will be appreciated by the those of ordinary skill in the art, having regard of this disclosure, that other variations and embodiments of this invention beyond those specifically described herein are possible, and are within the scope of the present invention. The scope of this invention is limited only as defined in the following claims and their equivalents.

What is claimed is:

1. Apparatus for stitching together the ends of a side panel of a mattress sack or enclosure for a box spring, said apparatus comprising:

a stitching machine having two sewing needles and apparatus for feeding the side panel to the two sewing needles in a feed direction, the two sewing needles being offset from one another in a direction perpendicular to the feed direction;

a guide plate extending in a direction parallel to the feed direction for guiding movement of the two ends of the side panel to and past the two needles in the feed direction, the two ends sliding in abutting relationship with the guide plate during the sewing process;

a first light source and associated first photocell generally aligned in the feed direction with a first needle encountered by the side panel as it moves to and through the needles in the feed direction; a controller for initiating a stitching operation in response to interruption of light from the first light source; and a second light source and associated second photocell disposed in the feed direction after the second needle encountered by the side panel as it moves to and through needles in the feed direction, receipt by the second photocell of light from the second light source after the second light source has been interrupted causing said controller to stop the stitching operation after a predetermined number of stitches.

2. The apparatus as recited in claim 1 further comprising:

a hole disposed after the second photocell in the feed direction and coupled to a source of vacuum for sucking loose threads into the hole; and a cutter associated with the hole for cutting loose threads on the panel.

3. The apparatus as recited in claim 1 further comprising a transparent protective plate covering a portion of an area before and adjacent the needles in the feed direction.

4. The apparatus as recited in claim 1 wherein the first and second photocells and associated first and second light sources are spaced from both of the needles in a direction transverse to the feed direction.

5. The apparatus as recited in claim 1 further comprising a switch which must be manually triggered to permit the controller to commence a sewing operation upon interruption of a light beam from the first light source with respect to the first photocell.

6. A method for preparing a side panel for a mattress sack or box spring enclosure, the method comprising the steps of:

cutting an elongated strip of material to a width equal to the desired width of the side panel of the mattress sack or box spring enclosure and to a length which is a predetermined amount greater than a circumference of the mattress sack or box spring enclosure;

folding the strip of material in half longitudinally along a transverse fold so that ends of the strip are aligned with one another and so that transverse sides of the strip of material are aligned;

manually placing the aligned ends of the strip of material in a loading zone in a stitching machine having two sewing needles spaced from one another in the feed direction and in a direction perpendicular to the feed direction;

placing the aligned ends of the strip of material against a guide plate which extends in a direction of feed of the material through the stitching machine, the guide plate being spaced a predetermined distance from the needles of the stitching machine in a direction transverse to the direction of feed;

manually moving the side panel in the feed direction toward the sewing needles until a light beam from a first light source is interrupted with respect to a first photocell;

commencing a sewing operation and automatic feeding of the strip of material through the stitching machine after interruption of the light beam from the first photocell;

sewing two parallel stitches on the side panel; and stopping the sewing operation after resumption of a beam from a second light source with respect to a second photocell at a location after a second sewing needle in the feed direction.

7. The method as recited in claim 6 further comprising the step of continuing the sewing operation for a predetermined number of stitches after resumption of the light beam from the second light source with respect to the second photocell.

8. The method as recited in claim 6 further comprising the step of manually operating a switch to initiate the sewing operation prior to said commencing step.

9. The method as recited in claim 6 further comprising the step of stopping the sewing operation if the light beam from the second light source is not interrupted after a predetermined number of stitches after interruption of the first light beam from the first light source.

* * * * *